US009259822B2

(12) United States Patent
Chou et al.

(10) Patent No.: US 9,259,822 B2
(45) Date of Patent: Feb. 16, 2016

(54) CHEMICAL MECHANICAL POLISHING CONDITIONER AND MANUFACTURING METHODS THEREOF

(71) Applicant: Kinik Company, Taipei (TW)

(72) Inventors: Jui-Lin Chou, Hualien County (TW); Chia Chun Wang, New Taipei (TW); Chia-Feng Chiu, New Taipei (TW); Chung-Yi Cheng, New Taipei (TW)

(73) Assignee: Kinik Company, Taipei (TW)

( * ) Notice: Subject to any disclaimer, the term of this patent is extended or adjusted under 35 U.S.C. 154(b) by 0 days.

(21) Appl. No.: 14/198,162

(22) Filed: Mar. 5, 2014

(65) Prior Publication Data

US 2014/0273772 A1 Sep. 18, 2014

(30) Foreign Application Priority Data

Mar. 15, 2013 (TW) ..... 102109201 A

(51) Int. Cl.

| | |
|---|---|
| ***B24B 53/00*** | (2006.01) |
| ***B24D 3/06*** | (2006.01) |
| ***B24D 7/18*** | (2006.01) |
| ***B24B 53/017*** | (2012.01) |
| ***B24B 53/12*** | (2006.01) |

(52) U.S. Cl.

CPC ..... *B24B 53/017* (2013.01); *B24B 53/12* (2013.01); *B24D 7/18* (2013.01)

(58) Field of Classification Search

CPC ..... B24B 53/017; B24B 53/12; B24B 37/04; B24D 3/06; B24D 18/00

USPC ..... 451/21, 56, 72, 443, 444, 548, 550; 51/293, 298, 305; 264/131, 134

See application file for complete search history.

(56) References Cited

U.S. PATENT DOCUMENTS

| | | | | |
|---|---|---|---|---|
| 5,069,978 | A * | 12/1991 | Mizuhara | 428/594 |
| 5,626,509 | A * | 5/1997 | Hayashi | 451/285 |
| 6,190,240 | B1 * | 2/2001 | Kinoshita et al. | 451/56 |
| 6,213,856 | B1 * | 4/2001 | Cho et al. | 451/443 |
| 6,302,771 | B1 * | 10/2001 | Liu et al. | 451/56 |
| 6,368,198 | B1 * | 4/2002 | Sung et al. | 451/443 |
| 6,843,952 | B1 * | 1/2005 | Yokoyama | 264/496 |
| 7,258,708 | B2 * | 8/2007 | Sung | 51/307 |
| 7,285,039 | B1 * | 10/2007 | Sung | 451/56 |
| 7,858,172 | B2 * | 12/2010 | Imaizumi et al. | 428/297.4 |
| 2004/0180617 | A1 * | 9/2004 | Goers | 451/443 |
| 2006/0079162 | A1 * | 4/2006 | Yamashita et al. | 451/444 |
| 2006/0276111 | A1 * | 12/2006 | Tian et al. | 451/56 |
| 2007/0066194 | A1 * | 3/2007 | Wielonski et al. | 451/443 |

(Continued)

*Primary Examiner* — George Nguyen

(74) *Attorney, Agent, or Firm* — Muncy, Geissler, Olds & Lowe, P.C.

(57) ABSTRACT

The present invention relates to a chemical mechanical polishing conditioner and manufacturing methods thereof. The chemical mechanical polishing conditioner comprises: a planar substrate having a leveling surface; a bonding layer disposed on the surface of the planar substrate; and a plurality of abrasive particles embedded in the surface of the bonding layer and fixed to the surface of the planar substrate by the binding layer; wherein the planar substrate is formed by a deformation compensation for the non-planar substrate during curing the binding layer, and thus the tips of the abrasive particles have a leveled height. Therefore, the present invention can effectively improve the problem of thermal deformation of the substrate of the chemical mechanical polishing conditioner during heating and curing process, and thereby enhancing the surface flatness of chemical mechanical polishing conditioner.

11 Claims, 6 Drawing Sheets

(56) References Cited

U.S. PATENT DOCUMENTS

| | | | | |
|---|---|---|---|---|
| 2008/0131723 | A1* | 6/2008 | Tucker et al. | 428/623 |
| 2009/0275274 | A1* | 11/2009 | Sakamoto et al. | 451/443 |
| 2009/0325472 | A1* | 12/2009 | Wu et al. | 451/443 |
| 2010/0022174 | A1* | 1/2010 | Chou et al. | 451/548 |
| 2010/0248595 | A1* | 9/2010 | Dinh-Ngoc et al. | 451/56 |
| 2011/0081848 | A1* | 4/2011 | Chen | 451/443 |
| 2012/0122377 | A1* | 5/2012 | Wu et al. | 451/56 |
| 2012/0149289 | A1* | 6/2012 | Lee et al. | 451/541 |
| 2012/0244790 | A1* | 9/2012 | Sung | 451/443 |
| 2012/0302146 | A1* | 11/2012 | Sung | 451/443 |
| 2013/0165023 | A1* | 6/2013 | Sung | 451/56 |

* cited by examiner

CHEMICAL MECHANICAL POLISHING CONDITIONER AND MANUFACTURING METHODS THEREOF

CROSS REFERENCE TO RELATED APPLICATION

This application claims the benefits of the Taiwan Patent Application Serial Number 102109201, filed on Mar. 15, 2013, the subject matter of which is incorporated herein by reference.

BACKGROUND OF THE INVENTION

1. Field of the Invention

The present invention relates to a chemical mechanical polishing conditioner and manufacturing methods thereof, and more particularly to a chemical mechanical polishing conditioner which has a deformation compensation in the manufacturing process.

2. Description of Related Art

Chemical mechanical polishing (CMP) is a common polishing process in various industries, which can be used to grind the surfaces of various articles, including ceramics, silicon, glass, quartz, or a metal chip. In addition, with the rapid development of integrated circuits, chemical mechanical polishing becomes one of the common techniques for wafer planarization because it can achieve an object of whole planarization.

During the chemical mechanical polishing process of semiconductor, impurities or uneven structure on the surface of a wafer are removed by contacting the wafer (or the other semiconductor elements) with a polishing pad and using a polishing liquid if necessary, through the chemical reaction and mechanical force. When the polishing pad has been used for a certain period of time, the polishing performance and efficiency are reduced because the debris produced in the polishing process may accumulate on the surface of the polishing pad. Therefore, a conditioner can be used to condition the surface of the polishing pad, such that the surface of the polishing pad is re-roughened and maintained at an optimum condition for polishing. In the process for manufacturing a conditioner, it is necessary to dispose an abrasive layer by mixing abrasive particles and a binding layer on the substrate surface, and to fix the abrasive layer to the surface of the substrate by brazing or sintering methods. However, during curing of the abrasive layer, the surface of the substrate may be deformed because of the difference in thermal expansion coefficient between the abrasive layer and the substrate, thus destroying flatness of the abrasive particles of the conditioner and thereby adversely affecting the polishing efficiency and service life of the conditioner.

In the known technology, the surface flatness of a chemical mechanical polishing conditioner is typically controlled by two ways. One way is to dispose the abrasive particles and the binding layer on the surface of the substrate, followed by pressing down the abrasive particles using a rigid plate to embed and fix the abrasive particles into the abrasive layer such that the surfaces of the abrasive particles and the rigid flat may have the same flatness. Another way is to dispose the abrasive particles into a recess of a mold, followed by covering the non-working surface of the abrasive particles with a binding layer and a substrate, and performing heat curing, and finally, flipping the mold upside down to separate the cured chemical mechanical polishing conditioner from the recess of the mold. In the above two methods for manufacturing the chemical mechanical polishing conditioner, they could be only aimed at controlling a tip height of the abrasive particle before heat-curing the abrasive layer; however, during heat-curing the binding layer, the difference in thermal expansion coefficient between the binding layer and the substrate may result in deformation of the substrate of the chemical mechanical polishing conditioner after curing, which results in deformation of the surface of the chemical mechanical polishing conditioner and destroys the flatness of the abrasive particles of the conditioner.

Besides, in the other known technology, it discloses to provide a non-planar substrate in which a planar substrate is formed by compensation for the deformation of non-planar substrate during curing the bonding layer, and thereby obtaining a chemical mechanical polishing conditioner having a planarization surface. A non-planar substrate used in the known technology is a surface having a curved surface contour, such as a spherical surface contour or a non-spherical surface contour; however, the non-planar substrate of the curved surface contour still has many problems in the precision of a design of the curved surface thereof or manufacturing cost.

Therefore, there is an urgent need for a chemical mechanical polishing conditioner with a surface planarization, which cannot only solve a problem of surface deformation of the chemical mechanical polishing conditioner in a curing and molding process, but also further control the surface flatness of the chemical mechanical polishing conditioner.

SUMMARY OF THE INVENTION

An object of the present invention is to provide a chemical mechanical polishing conditioner to solve effectively the deformation of the substrate of the chemical mechanical polishing conditioner during curing, so as to achieve the surface flatness of the chemical mechanical polishing conditioner.

To achieve the above object, the present invention provides a chemical mechanical polishing conditioner, comprising: a planar substrate having a planar surface; a binding layer disposed on a surface of the planar substrate; and a plurality of abrasive particles embedded in a surface of the binding layer and fixed to the surface of the planar substrate by the binding layer, wherein tips of the abrasive particles have a leveled height. Besides, in the chemical mechanical polishing conditioner of the present invention, a contour of the planar substrate may be randomly varied based on a device for polishing processing or requirements, and the contour of the planar substrate may be a central concave circular contour or a whole planar circular contour, but the present invention is not limited thereto. In a preferred aspect of the present invention, the contour of the planar substrate may be a central concave circular contour.

In the chemical mechanical polishing conditioner of the present invention, the planar substrate may be formed by a deformation compensation for non-planar substrate during curing the binding layer. Therefore, the present invention can solve the well-known problems which a surface of the chemical mechanical polishing conditioner is deformed during curing the binding layer by mean of designing a contour of the surface of the non-planar substrate. In the chemical mechanical polishing conditioner of the present invention, a surface of the non-planar substrate has an outer edge region of the substrate and a center surface region of the substrate, and a working surface is formed between the outer edge region of the substrate and a center surface region of the substrate; wherein the working surface has a linear contour, and a height or height difference of the non-planar substrate may be randomly varied based on a deformation degree thereof during curing the binding layer, so that the height of the non-planar substrate can be reduced from the outer edge region of the substrate to the center surface region of the substrate, or the height of the non-planar substrate can be increased from the outer edge region of the substrate to the center surface region of the substrate, but the present invention is not particularly limited. In an aspect of the present invention, it is different from a well-known technology that the used non-planar substrate has a tilted surface of outside higher than inside; therefore, the surface of the non-planar substrate having linear contour (or a working surface) can has a function of a deformation compensation for a central protrusion during curing the binding layer. In another aspect of the present invention, the used non-planar substrate has a tilted surface of inside higher than outside; therefore, the surface of the non-planar substrate having linear contour (or a working surface) can has a function of a deformation compensation for a central concave during curing the binding layer. Hence, the chemical mechanical polishing conditioner of the present invention can avoid a deformation of a bottom substrate of the chemical mechanical polishing conditioner after curing due to the difference of a thermal expansion coefficient between the abrasive layer and the substrate, and prevent a deformation of a surface of the chemical mechanical polishing conditioner therewith; and thereby remaining the surface flatness of the conditioner and the polishing quality and performance.

In the chemical mechanical polishing conditioner of the present invention, the heights and the height differences of the outer edge region of the substrate and the central surface region of the substrate may be randomly varied based on polishing processing requirements; wherein the height differences of the outer edge region of the substrate and the center surface region of the substrate may be 1% to 5% of thickness of the non-planar substrate, and the height differences of the outer edge region of the substrate and the central surface region of the substrate may be 5 to 500 μm, but the present invention is not limited thereto. In an aspect of the present invention, the height differences of the outer edge region of the substrate and the center surface region of the substrate may be 2% of the thickness of the non-planar substrate. In the other aspect of the present invention, the height differences of the outer edge region of the substrate and the center surface region of the substrate may be 50 to 150 μm. In another aspect of the present invention, the height differences of the outer edge region of the substrate and the center surface region of the substrate may be 120 μm.

In the chemical mechanical polishing conditioner of the present invention, the materials and sizes of the planar substrate may be randomly varied based on a polishing processing conditions and requirements; wherein the materials of the non-planar substrate may be stainless steel, mold steel, metal alloy or ceramic material etc., but the present invention is not be limited thereto. In a preferred aspect of the present invention, the material of the non-planar substrate may be a type 316 stainless steel having a thermal expansion coefficient of about 16 ppm/° C. Besides, in the chemical mechanical polishing conditioner of the present invention, the thickness of the planar substrate may be 3 to 50 mm, and a diameter of the planar substrate may be 10 to 120 mm, but the present invention is not be limited thereto. In a preferred aspect of the present invention, the thickness of the planar substrate may be 6 mm, and the diameter of the planar substrate may be 100 mm.

In the chemical mechanical polishing conditioner of the present invention, the composition of the binding layer or the composition of the abrasive particles may be varied based on the polishing processing conditions and requirements; wherein the binding layer may be a brazing layer, a resin layer, a electroplating layer, or a ceramic layer, but the present invention is not limited thereto. In a preferred aspect of the present invention, the binding layer may be a brazing layer. The brazing layer may be at least one selected from the group consisting of iron, cobalt, nickel, chromium, manganese, silicon, aluminum, and combinations thereof, and the brazing layer has a thermal expansion coefficient of about 14 to 15 ppm/° C. Besides, in the chemical mechanical polishing conditioner of the present invention, the abrasive particles may be diamond or cubic boron nitride; and in a preferred aspect of the present invention, the abrasive particles may be diamond. In addition, in the chemical mechanical polishing conditioner of the present invention, the abrasive particles may have a particle size of 30 to 600 μm; and in a preferred aspect of the present invention, the abrasive particles may have a particle size of 200 μm.

Another object of the present invention is to provide a method for manufacturing a chemical mechanical polishing conditioner to obtain the above-mentioned chemical mechanical polishing conditioner, and effectively solve problems of the deformation of the substrate of the chemical mechanical polishing conditioner during curing and molding process, so as to achieve the surface flatness of the chemical mechanical polishing conditioner.

To achieve the above object, the present invention provides a method for manufacturing a chemical mechanical polishing conditioner, comprising: (A) providing a non-planar substrate; (B) providing a binding layer disposed on the surface of the non-planar substrate; (C) providing a plurality of abrasive particles embedded in a surface of the binding layer, and (D) heat curing the binding layer, such that the abrasive particles are fixed to a surface of the planar substrate by the binding layer, and the non-planar substrate is performed a deformation compensation during curing the binding layer to form a planar substrate; wherein after step (D), tips of the abrasive particles have a leveled height. Besides, in the method for manufacturing a chemical mechanical polishing conditioner of the present invention, a contour of the planar substrate may be randomly varied based on a device for polishing processing or requirements, and the contour of the planar substrate may be a central concave circular contour or a whole planar circular contour, but the present invention is not limited thereto. In a preferred aspect of the present invention, the contour of the planar substrate may be a central concave circular contour.

In the method for manufacturing a chemical mechanical polishing conditioner of the present invention, the planar substrate may be formed by a deformation compensation for non-planar substrate during curing the binding layer. Therefore, the present invention can solve the problem which a surface of the chemical mechanical polishing conditioner is deformed during curing the binding layer by means of designing a contour of the non-planar substrate. In the method for manufacturing a chemical mechanical polishing conditioner of the present invention, a surface of the non-planar substrate has an outer edge region of the substrate and a center surface region of the substrate, and a working surface is formed between the outer edge region of the substrate and a center surface region of the substrate; wherein the working surface may be a linear contour, and the height of the non-planar substrate can be reduced from the outer edge region of the substrate to the center surface region of the substrate. In an aspect of the present invention, it is different from a well-known technology that the used non-planar substrate has a tilted surface of outside higher than inside; therefore, the surface of the non-planar substrate having linear contour (or a working surface) can has a function of a deformation compensation for a central protrusion during curing the binding layer. In another aspect of the present invention, the used non-planar substrate has a tilted surface of inside higher than outside; therefore, the surface of the non-planar substrate having a linear contour (or a working surface) can has a function of a deformation compensation for a central concave during curing the binding layer. Hence, the chemical mechanical polishing conditioner of the present invention can avoid a deformation of a bottom substrate of the chemical mechanical polishing conditioner after curing due to the difference of a thermal expansion coefficient between the binding layer and the substrate, and prevent a deformation of a surface of the chemical mechanical polishing conditioner therewith; and thereby remaining the surface flatness of the conditioner and the polishing quality and performance.

In the method for manufacturing a chemical mechanical polishing conditioner of the present invention, the heights and the height differences of the outer edge region of the substrate and the central surface region of the substrate may be randomly varied based on a polishing processing requirements; wherein the height differences of the outer edge region of the substrate and the central surface region of the substrate may be 1% to 5% of thickness of the non-planar substrate, and the height differences of the outer edge region of the substrate and the central surface region of the substrate may be 5 to 500 mm, but the present invention is not limited thereto. In an aspect of the present invention, the height differences of the outer edge region of the substrate and the central surface region of the substrate may be 2% of the thickness of the non-planar substrate. In another aspect of the present invention, the height differences of the outer edge region of the substrate and the central surface region of the substrate may be 5 to 150 micrometers. In the other aspect of the present invention, the height differences of the outer edge region of the substrate and the central surface region of the substrate may be 120 mm.

In the method for manufacturing a chemical mechanical polishing conditioner of the present invention, the curing method of the bonding layer or the composition or size of the abrasive particles may be may be randomly varied based on a polishing processing conditions and requirements; wherein the method for heating and curing the binding layer may be brazing, heat-curing, ultraviolet radiation curing, electroplating, or sintering, but the present invention is not limited thereto. In a preferred aspect of the present invention, the method for heating and curing the binding layer may be brazing; wherein the binding layer may be a brazing layer, a resin layer, and the brazing layer may be at least one selected from the group consisting of iron, cobalt, nickel, chromium, manganese, silicon, aluminum, and combinations thereof, having a thermal expansion coefficient of about 14 to 15 ppm/° C. Besides, in the method for manufacturing a chemical mechanical polishing conditioner of the present invention, the abrasive particles may be diamond or cubic boron nitride. In a preferred aspect of the present invention, the abrasive particles may be diamond. In addition, in the method for manufacturing a chemical mechanical polishing conditioner of the present invention, the abrasive particles may have a particle size of 30 to 600 μm. In a preferred aspect of the present invention, the abrasive particles may have a particle size of 200 μm.

In the method for manufacturing a chemical mechanical polishing conditioner of the present invention, in the step (C), the abrasive particles may be embedded in the surface of the binding layer by any well-known method, and the abrasive particles may have a pattern arrangement; wherein the abrasive particles are arranged in uniformly spaced arrangement or non-uniformly spaced arrangement, such as an array pattern arrangement, a concentric circles pattern arrangement or a radial pattern arrangement etc., but the present invention is not limited thereto. In a preferred aspect of the present invention, the abrasive particles may be embedded in the surface of the binding layer by a template, and the abrasive particles may have a pattern arrangement.

In summary, according to the method for manufacturing a chemical mechanical polishing conditioner of the present invention, the problem of the deformation of the substrate of the chemical mechanical polishing conditioner during curing may be effectively solved, and the surface flatness of the chemical mechanical polishing conditioner may be controlled, and thereby increasing the polishing efficiency and service life of the conditioner.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Hereinafter, the actions and the effects of the present invention will be explained in more detail via specific examples of the invention. However, these examples are merely illustrative of the present invention and the scope of the invention should not be construed to be defined thereby.

COMPARATIVE EXAMPLE

Figure 1A:
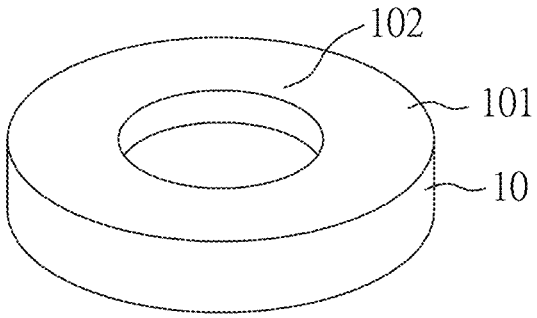
FIG.1A Prior Art
FIGS. 1A, 1B, 1C, 1C', 1D, and 1D' show a conventional process flow for manufacturing a chemical mechanical polishing conditioner.
Figure 1B:
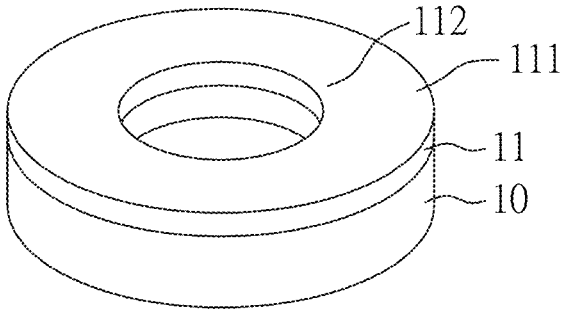
FIG.1B Prior Art
Figure 1C:
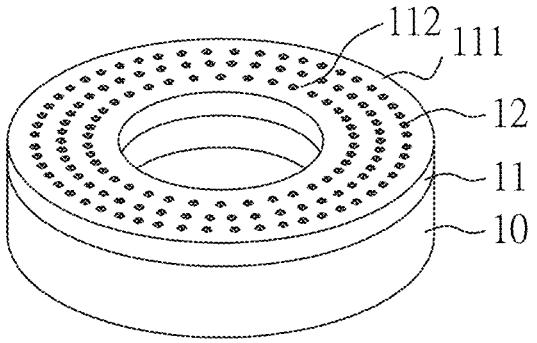
FIG.1C Prior Art
Figure 1C:
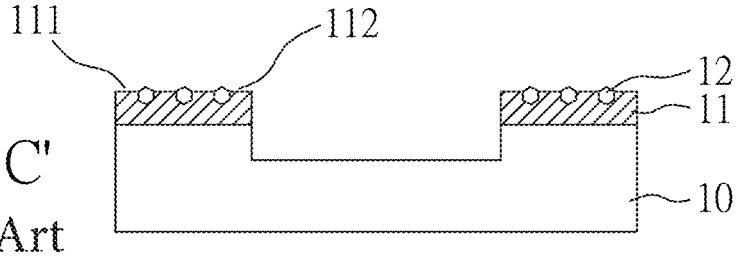
FIG.1C' Prior Art
Figure 1D:
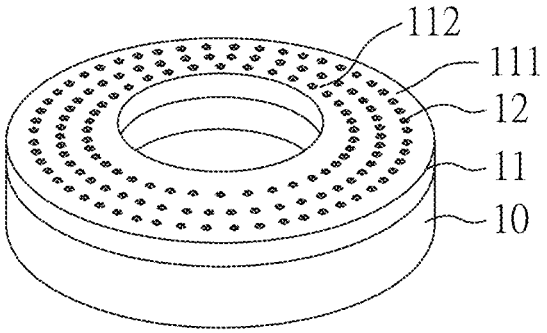
FIG.1D Prior Art
Figure 1D:
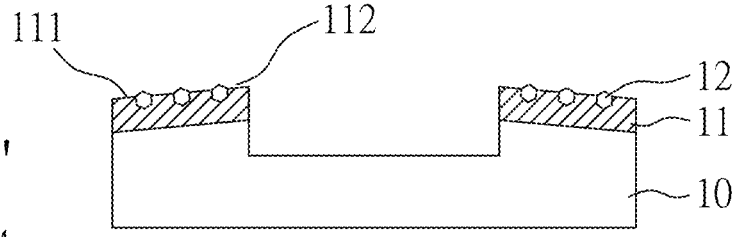
FIG.1D' Prior Art

Please refer to FIGS. 1A to 1D', the conventional process flow for manufacturing a chemical mechanical polishing conditioner is shown. First, as shown in FIG. 1A, a planar substrate 10 made of stainless steel which has a central concave circular contour is provided, or a whole planar circular disk is provided based on a polishing processing requirements. Besides, the surface of the substrate has an outer edge region 101 of the substrate and a center surface region 102 of the substrate, and the outer edge region 101 of the substrate and a center surface region 102 of the substrate have equivalent heights, so that the outer edge region 101 of the substrate and the center surface region 102 of the substrate form a working surface. Furthermore, the binding layer 11 is disposed on the substrate 10; wherein the surface of the binding layer 11 has an outer edge region 111 of the binding layer and a center surface region 112 of the binding layer, and the binding layer 11 on the substrate 10 has a uniform thickness. Therefore, the outer edge region 111 of the binding layer and the center surface region 112 of the binding layer also have uniform thickness, so that the height of the chemical mechanical polishing conditioner forms a plane surface from the outer edge region 111 of the binding layer to the center surface region 112 of the binding layer; wherein the binding layer is a conventional brazing metal powder, such as copper-nickel brazing, copper-nickel brazing or copper-manganese-nickel brazing etc., as shown in FIG. 1B. Furthermore, the abrasive particles 12 are embedded in the binding layer 11; wherein the abrasive particles 12 are diamonds having particle diameters of 200 μm, and the arrangement of the abrasive particles 12 may be a known diamond distribution technique, for example, template distribution. The spacing and arrangement of the abrasive particles 12 may be controlled by the template (not shown), as shown in FIGS. 1C and 1C'. Finally, the abrasive particles 12 are hard-brazed and fixed to the surface of the substrate 10 by a heat-curing process through the binding layer 11 made of brazing metal powders, please refer to FIGS. 1D and 1D'.

In a conventional chemical mechanical polishing conditioner, the substrate 10 of the chemical mechanical polishing conditioner is deformed after curing because of the differences of thermal expansion coefficients between the binding layer 11 (having a thermal expansion coefficient of about 14 to 15 ppm/° C.) and a substrate 10 (having a thermal expansion coefficient of about 16 ppm/° C.). Meanwhile the binding layer 11 on the surface of the substrate is also deformed therewith, please refer to FIGS. 1D and 1D'; wherein the center surface region 112 of the binding layer has a height higher than the outer edge region 111 of the binding layer, so that the height of the chemical mechanical polishing conditioner is increased from the outer edge region 111 of the binding layer toward to the center surface region 112 of the binding layer, and thereby deteriorating the flatness of the surface of the chemical mechanical polishing conditioner and polishing performance.

EXAMPLE 1

Figure 2A:
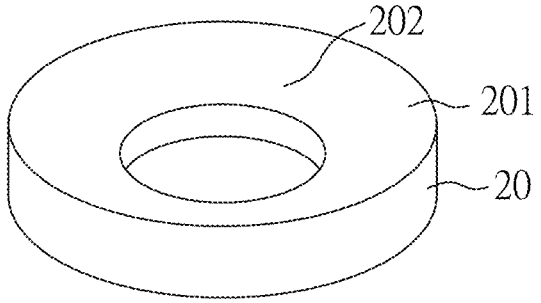
FIGS. 2A, 2B, 2C, 2C', 2D, and 2D' show a process flow for manufacturing the chemical mechanical polishing conditioner of the present invention.
Figure 2B:
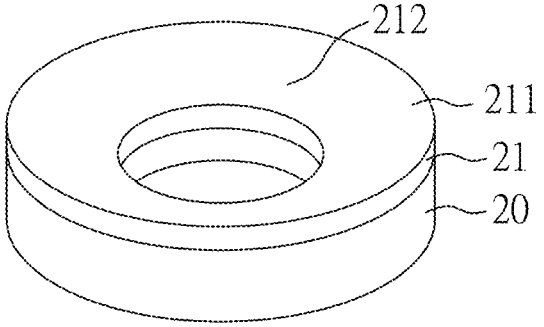
Figure 2C:
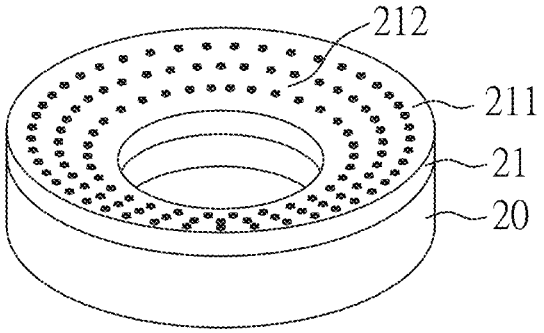
Figure 2C:
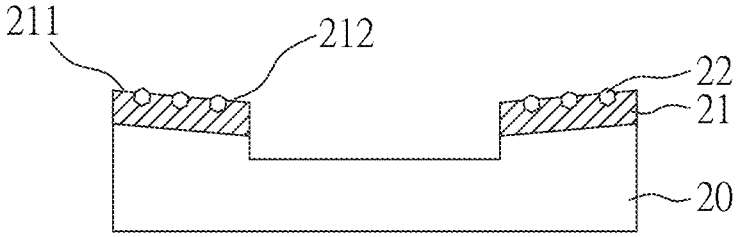
Figure 2D:
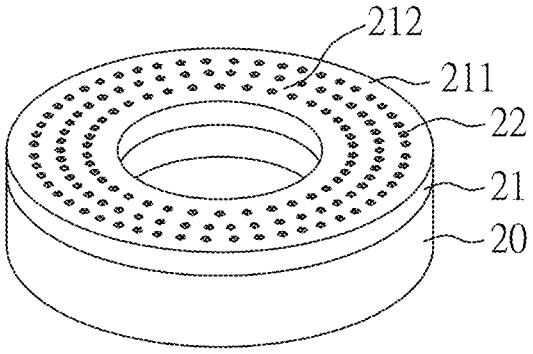
Figure 2D:
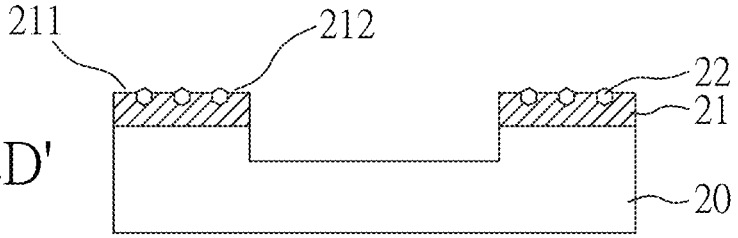

Please refer to FIGS. 2A to 2D', a process flow for manufacturing a chemical mechanical polishing conditioner of example 1 of the present invention is shown. First, as shown in FIG. 2A, a non-planar substrate 20 made of stainless steel which has a central concave circular contour is provided; wherein a surface of the substrate 20 has an outer edge region 201 of the substrate and the center surface region 112 of the substrate, and the outer edge region 201 of the substrate has a height higher than the center surface region 202 of the substrate, so that the height of the surface of the substrate 20 is reduced from the outer edge region 201 of the substrate toward to the center surface region 202 of the substrate, and a tilted working surface of outside higher inside is formed between the outer edge region 201 and the center surface region 202, as well as the working surface is a linear contour. Furthermore, the binding layer is disposed on the substrate 20; wherein a surface of the binding layer has an outer edge region 211 of the binding layer and a center surface region 212 of the binding layer, and the outer edge region 211 of the binding layer has a height higher than the center surface region 212 of the binding layer because of the binding layer on the substrate 20 having a uniform thickness, so that the height of the chemical mechanical polishing conditioner is reduced from the outer edge region 211 of the binding layer toward to the center surface region 212 of the binding layer. Besides, in example 1, the binding layer is a conventional brazing metal powder, such as copper-nickel brazing, copper-nickel brazing or copper-manganese-nickel brazing etc., as shown in FIG. 2B. Furthermore, the abrasive particles 22 are embedded in the binding layer 21; wherein the abrasive particles 22 are diamond having a particle size of 200 μm and the arrangement of the abrasive particles 12 may be a known diamond distribution technique, such as template distribution. The spacing and arrangement of the abrasive particles 12 may be controlled by the template (not shown), as shown in FIGS. 2C and 2C'. Finally, the abrasive particles 22 are hard-brazed and fixed to the surface of the substrate 20 by a heat-curing process through the binding layer 21 made of brazing metal powders, please refer to FIGS. 2D and 2D'; wherein the outer edge region 211 of the binding layer and the center surface region 212 of the binding layer have the same heights, so that the height of the chemical mechanical polishing form a plane surface from the outer edge region 211 of the binding layer to the center surface region 212 of the binding layer, and the chemical mechanical polishing conditioner may achieve expected polishing performance and polishing quality, please refer to FIGS. 2D and 2D'. Besides, in the above-mentioned chemical mechanical polishing conditioner of the present invention, the thickness and the diameter of the substrate are respectively 6 mm and 100 mm, and the height difference between the outer region 201 of the substrate and the center surface region 202 of the substrate is 120 μm; therefore, the height difference of the outer edge region 201 and of the substrate and the center surface region 202 of the substrate is 2% of the thickness of the substrate 20.

In the above-mentioned chemical mechanical polishing conditioner, the chemical mechanical polishing conditioner is deformed after curing because of the difference in thermal expansion coefficient between the binding layer 21 (having a thermal expansion coefficient of about 14 to 15 ppm/° C.) and the substrate 20 (having a thermal expansion coefficient of about 16 ppm/° C.); however, in the example 1, because the deformation degree of the substrate 20 is considered, the surfaces of the substrate 20 (such as the outer edge region 201 of the substrate and the center surface region 202 of the substrate) and the binding layer 21 (such as the outer edge region 211 of the binding layer and the center surface region 212 of the binding layer) are designed as different heights, for example, the height of the chemical mechanical polishing conditioner is designed as reducing from the outer edge region 211 of the binding layer toward to the center surface region 212 of the binding layer. Therefore, in the process for manufacturing a chemical mechanical polishing conditioner, the substrate 20 in a heating process may be performed a deformation compensation by previously designing the height difference of the substrate 20 or the height difference of the binding layer 21, please refer to FIGS. 2D and 2D'; wherein the outer edge region 211 of the binding layer and the center surface region 212 of the binding layer have the same height, so that the height of the chemical mechanical polishing conditioner form a plane surface from the outer edge region 211 of the binding layer to the center surface region 212 of the binding layer, and thereby the chemical mechanical polishing conditioner may achieve expected polishing performance and polishing quality. Besides, in the example 1, the height (or the height difference) of the substrate may be randomly varied based on the deformation degree during curing the binding layer, so that the height of the substrate 20 may be reduced from the outer edge region 201 of the substrate toward to the center surface region 202 of the substrate, or the height of the substrate 20 may be increased from the outer edge region 201 of the substrate toward to the center surface region 202 of the substrate, but the present invention is not limited thereto.

EXAMPLE 2

Figure 3A:
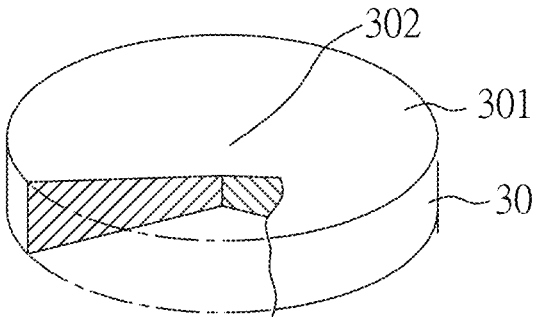
FIGS. 3A, 3B, 3C, 3C', 3D, and 3D' show a process flow for manufacturing the chemical mechanical polishing conditioner of the present invention.
Figure 3B:
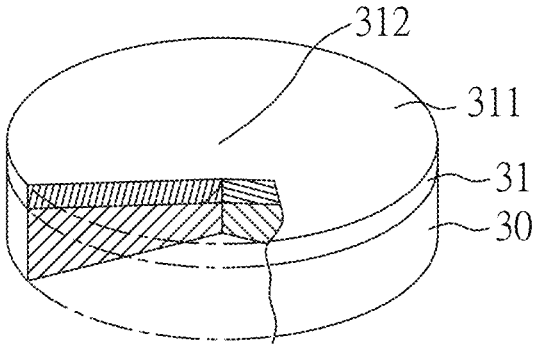
Figure 3C:
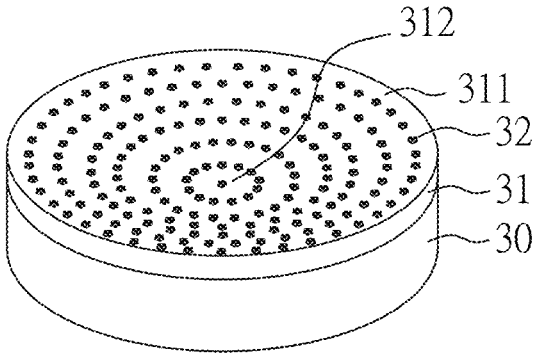
Figure 3C:
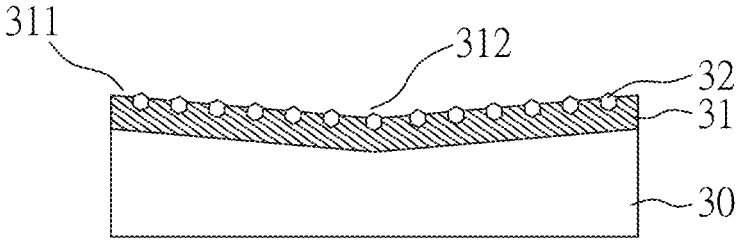
Figure 3D:
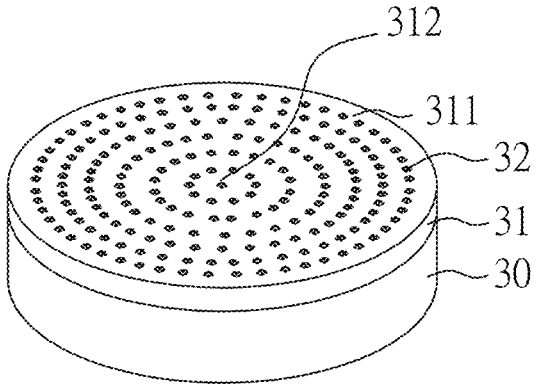
Figure 3D:
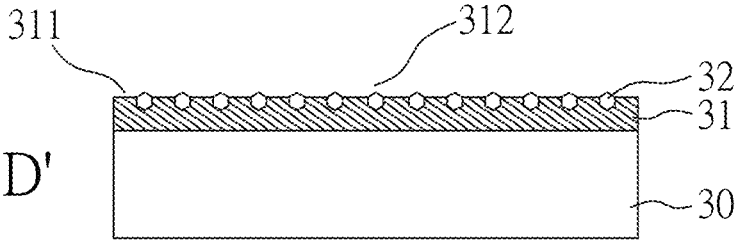

Please refer to FIGS. 3A to 3D', a process flow for manufacturing a chemical mechanical polishing conditioner of example 2 of the present invention is shown. The manufacturing process of Example 2 is substantially the same as the above Example 1, except that the structure of the substrate contour is different. First, as shown in FIG. 3A, a non-planar substrate 30 made of stainless steel which has a whole plane circular disk contour is provided; wherein a surface of the substrate 30 has an outer edge region 302 of the substrate and a center surface region 302 of the substrate, and the outer edge region 301 of the substrate has a height higher than the center surface region 302 of the substrate, so that a height of the surface of the substrate 30 is reduced from the outer region 301 of the substrate toward to the center surface region 302 of the substrate. Further, a tilted working surface of outer side higher than inside is formed between the outer edge region 301 of the substrate and the center surface region 302 of the substrate, and the working surface has a linear contour. Furthermore, the binding layer 31 is disposed on the substrate 30; wherein the surface of the binding layer 31 has an outer edge region 311 of the binding layer and a center surface region 312 of the binding layer, and the outer edge region 311 of the binding layer has a height higher than the center surface region 312 of the binding layer because of the binding layer 31 on the substrate 30 having a uniform thickness, so that the height of the chemical mechanical polishing conditioner is reduced from the outer edge region 311 of the binding layer toward to the center surface region 312 of the binding layer, as shown inn FIG. 3B. Furthermore, the abrasive particles 32 are embedded in the binding layer 31; wherein the abrasive particles 32 are diamond having a particle size of 200 μm and the arrangement of the abrasive particles 32 may be a known diamond distribution technique, such as template distribution. The spacing and arrangement of the abrasive particles 32 may be controlled by the template (not shown), as shown in FIGS. 3C and 3C'. Finally, the abrasive particles 32 are hard-brazed and fixed to the surface of the substrate 30 by a heat-curing process through the binding layer 21 made of brazing metal powders; wherein the outer edge region 311 of the binding layer and the center surface region 312 of the binding layer have the same heights, so that the height of the chemical mechanical polishing form a plane surface from the outer edge region 311 of the binding layer to the center surface region 312 of the binding layer, and thereby the chemical mechanical polishing conditioner may achieve expected polishing performance and polishing quality, please refer to FIGS. 3D and 3D'.

In the above mentioned chemical mechanical polishing conditioner, the chemical mechanical polishing conditioner is deformed after curing because of the difference in thermal expansion coefficient between the binding layer 31 and the substrate 30; however, in the example 2, because the actual deformation degree of the substrate 30 is considered, the surfaces of the substrate 30 (such as the outer edge region 301 of the substrate and the center surface region 302 of the substrate) and the binding layer 21 (such as the outer edge region 311 of the binding layer and the center surface region 312 of the binding layer) are designed as different heights, for example, the height of the chemical mechanical polishing conditioner is designed as reducing from the outer edge region 311 of the binding layer toward to the center surface region 312 of the binding layer. Therefore, in the process for manufacturing a chemical mechanical polishing conditioner, the substrate 30 in a heating process may be performed a deformation compensation by previously designing the height difference of the substrate 30 or the height difference of the binding layer 31, please refer to FIGS. 3D and 3D'; wherein the outer edge region 311 of the binding layer and the center surface region 312 of the binding layer have the same height, so that the height of the chemical mechanical polishing conditioner forms a plane surface from the outer edge region 311 of the binding layer to the center surface region 312 of the binding layer, and thereby the chemical mechanical polishing conditioner may achieve expected polishing performance and polishing quality. Besides, in the example 2, the heights (or the height differences) of the substrate 30 may be randomly varied based on the deformation degree during curing the binding layer, so that the height of the substrate 30 may be reduced from the outer edge region 301 of the substrate toward to the center surface region 302 of the substrate, or the height of the substrate 30 may be increased from the outer edge region 301 of the substrate toward to the center surface region 302 of the substrate, but the present invention is not limited thereto.

It should be understood that these examples are merely illustrative of the present invention and the scope of the invention should not be construed to be defined thereby, and the scope of the present invention will be limited only by the appended claims.

What is claimed is:

1. A method for manufacturing a chemical mechanical polishing conditioner, comprising:

(A) providing a non-planar substrate;

(B) providing a binding layer disposed on the surface of the non-planar substrate;

(C) providing a plurality of abrasive particles embedded in a surface of the binding layer, and (D) heat curing the binding layer, such that the abrasive particles are fixed to a surface of the planar substrate by the binding layer, and the non-planar substrate is performed a deformation compensation to form a planar substrate during curing the binding layer;

wherein after step (D), tips of the abrasive particles have a leveled height.

2. The method for manufacturing a chemical mechanical polishing conditioner of claim 1, wherein the planar substrate has a central concave circular contour.

3. The method for manufacturing a chemical mechanical polishing conditioner of claim 1, wherein a surface of the non-planar substrate has an outer edge region of the substrate and a center surface region of the substrate, and a working surface is formed between the outer edge region of the substrate and center surface region of the substrate.

4. The method for manufacturing a chemical mechanical polishing conditioner of claim 3, wherein the working surface has a linear contour, and a height of the non-planar substrate is reduced from the outer edge region of the substrate toward to the center surface region of the substrate, or a height of the non-planar substrate is increased from the outer edge region of the substrate toward to the center surface region of the substrate.

5. The method for manufacturing a chemical mechanical polishing conditioner of claim 3, wherein a height difference between the outer edge region of the substrate and the center surface region of the substrate is 1% to 5% of the thickness of the non-planar substrate.

6. The method for manufacturing a chemical mechanical polishing conditioner of claim 3, wherein the height difference between the outer edge region of the substrate and the center surface region of the substrate is 5 to 500 μm.

7. The method for manufacturing a chemical mechanical polishing conditioner of claim 3, wherein the heat curing of the binding layer is performed by brazing, heat-curing, ultraviolet radiation curing, electroplating, or sintering.

8. The method for manufacturing a chemical mechanical polishing conditioner of claim 1, wherein the abrasive particles are diamond or cubic boron nitride.

9. The method for manufacturing a chemical mechanical polishing conditioner of claim 1, wherein the abrasive particles have a particle size of 30 to 600 μm.

10. The method for manufacturing a chemical mechanical polishing conditioner of claim 1, wherein in the step (C), the abrasive particles are embedded in the surface of the binding layer by a template, and the abrasive particles have a pattern arrangement.

11. A chemical mechanical polishing conditioner made by the method for manufacturing according to claim 1.

* * * * *